US005333684A

United States Patent [19]

Walter et al.

[11] Patent Number: 5,333,684

[45] Date of Patent: Aug. 2, 1994

[54] DOWNHOLE GAS SEPARATOR

[75] Inventors: James C. Walter, Austin; Billy R. Bruton, Longview; George E. Walter, Jr., Tyler, all of Tex.

[73] Assignee: James C. Walter, Austin, Tex.

[21] Appl. No.: 862,424

[22] Filed: Apr. 2, 1992

Related U.S. Application Data

[63] Continuation-in-part of Ser. No. 480,952, Feb. 16, 1990, Pat. No. 5,127,803.

[51] Int. Cl.[5] ..... E21B 43/38

[52] U.S. Cl. ..... 166/54; 166/105.5

[58] Field of Search ..... 166/54, 105.5; 55/170, 55/165, 169, 166; 137/101.27

[56] References Cited

U.S. PATENT DOCUMENTS

| | | | |
|---|---|---|---|
| 1,819,994 | 8/1931 | Claytor . | |
| 1,836,871 | 12/1931 | Ricker . | |
| 1,846,000 | 2/1932 | Fletcher . | |
| 1,919,547 | 4/1933 | Fletcher . | |
| 1,947,511 | 2/1934 | Baggett . | |
| 2,001,012 | 5/1935 | Burgher . | |
| 2,142,376 | 1/1939 | Rodgers | 166/54 |
| 2,237,408 | 4/1941 | Burgher . | |
| 2,267,902 | 12/1941 | Eddins . | |
| 2,349,164 | 5/1944 | Gilbert | 166/105.5 X |
| 2,491,587 | 12/1949 | Seago | 55/169 X |
| 2,513,031 | 6/1950 | Lewellen | 166/54 X |
| 2,652,130 | 9/1953 | Ferguson | 166/54 |
| 2,714,855 | 8/1955 | Brown . | |
| 2,762,437 | 9/1956 | Egan et al. | 166/54 |
| 2,810,352 | 10/1957 | Tumlison | 166/54 |
| 2,865,455 | 12/1958 | Rhoads | 166/170 |
| 2,937,598 | 5/1960 | Brown . | |
| 3,095,819 | 7/1963 | Brown . | |
| 3,359,708 | 12/1967 | Barber | 55/170 |
| 3,410,217 | 4/1967 | Kelley et al. | 103/52 |
| 3,424,066 | 1/1969 | Moore | 92/193 |
| 3,451,477 | 6/1969 | Kelley | 166/54 |
| 4,070,134 | 1/1987 | Gramling | 417/56 |
| 4,259,858 | 4/1987 | Freeman et al. | 72/391 |
| 4,465,435 | 8/1987 | Copas | 417/56 |
| 4,696,624 | 9/1987 | Bass et al. | 417/56 |
| 4,712,981 | 12/1987 | Gramling | 417/56 |
| 4,880,366 | 11/1989 | Stinson | 417/555.1 |
| 4,889,473 | 12/1989 | Krueger | 417/56 |

FOREIGN PATENT DOCUMENTS 525963 6/1956 Canada .

OTHER PUBLICATIONS

"Casing Pumps", Oil and Gas Journal, Apr. 13, 1987, pp. 42–47.

*Primary Examiner*—Hoang C. Dang

*Attorney, Agent, or Firm*—Richards, Medlock & Andrews

[57] ABSTRACT

A tool (400) is disclosed for use in recovering gas from a gas well without the production of water as well. The tool (400) uses a member, such as plurality of vertically stacked balls (430) which are lighter than water to close a channel 422 when the water level (432) exceeds a certain level. As gas accumulates about the balls, the water level 432 will be moved downwardly, eventually causing the balls to move out of engagement with the seal surface (424), opening the channel (422) for passage of the gas upwardly for recovery. As the water level rises, the balls will again seal against the seal surface (424).

9 Claims, 14 Drawing Sheets

DOWNHOLE GAS SEPARATOR

CROSS REFERENCE TO RELATED APPLICATION

This application is a continuation-in-part of U.S. patent application Ser. No. 480,952, filed Feb. 16, 1990 and issued as U.S. Pat. No. 5,127,803, issued Jul. 7, 1992.

REFERENCE TO DISCLOSURE DOCUMENT

A disclosure document, Document No. 278342 was filed in the U.S. Patent and Trademark Office on Apr. 9, 1991 with the title "Down-Hole Gas/Liquid Separator." A separate letter identifying this disclosure document is filed with this application. The U.S. Patent and Trademark Office is requested to retain this disclosure document with the patent application in accordance with the provisions of MPEP § 1706.

TECHNICAL FIELD

This invention relates to oil production, and in particular to a separator pump utilizing well gas pressure to separate gas and water.

BACKGROUND OF THE INVENTION

In the oil and gas production industry, natural gas wells frequently also produce salt water with the gas. This salt water frequently comes from the same geologic formation as the gas, and when lifted to the surface with the produced gas, must be disposed of in a safe and ecological manner. This fact places an economic burden upon a gas well since the salt water may only be disposed of in state regulated and approved wells, which frequently require the water to be trucked great distances due to their locations. Frequently, a pump jack must be used to lift the water to the surface. These are expensive to operate and have high maintenance costs and down time. In addition to the costs of pumping the water up, storage facilities must be provided on location to safely store the water. Trucking the water is costly, and a fee must be paid to use the state approved water disposal well. Thus, the concurrent production of salt water with natural gas places a heavy economic burden upon the gas well. Many otherwise profitable wells are rendered unprofitable by the economic burden of produced salt water.

In gas wells that produce salt water, there has to date been no choice but to produce the water with the gas. If the water is not removed from the well bore, a column of water will rise vertically up the well bore until the hydraulic head of this column has become equal to the pressure of the formation from which it originated. When this point of equilibrium is reached, no further gas production will occur and the well will remain in this state until the hydrostatic head is decreased.

The use of plunger pumps to produce oil from a well having usable gas pressure is well known. In basic principle, a plunger pump is dropped from the surface through the well casing or tubing and into the oil/gas mixture downhole. A mechanism, typically one operated by hydrostatic pressure, closes a passage in the plunger pump to allow gas pressure to build up beneath the pump. The gas pressure builds to a point where it lifts the pump, and a quantity of oil above the pump, to the surface where the oil is recovered. The gas pressure beneath the pump is relieved to allow the pump to fall downhole again to re-initiate the sequence.

One example of a plunger pump is disclosed in U.S. Pat. No. 4,070,134, issued Jan. 24, 1978 to Gramling. However, this device has not proven reliable in actual use, and a need exists for an improved plunger pump which provides for efficient production of oil, condensate, and de-watering of gas wells, either through casing or tubing. For simplicity, the following discussion will be limited to the plunger pump application in casing, with the understanding that the same principles of operation can be applied to its use in tubing.

SUMMARY OF THE INVENTION

In accordance with one aspect of the present invention, a tool is provided for separating gas and water in a natural gas well. The well has a casing and production tubing within the casing. The tool is part of the production tubing and includes a body defining an upper chamber, a lower chamber and a passage interconnecting the upper and lower chambers. The tool also includes a member having a density less than the water in the gas well. A seal surface is defined on the body about the passage, the member floating against the seal surface to seal the passage from the lower chamber when the level of water exceeds a predetermined height and floating away from the seal surface to release the seal, permitting gas to flow from the lower chamber to the upper chamber through the passage when the level of water is below the predetermined height.

In accordance with one aspect of the present invention, a tool is provided for pumping oil from a gaseous well through a casing of predetermined internal diameter extending from the surface to below the oil level. The tool includes a body formed of plastic, with the body defining an upper chamber and a lower chamber therein. At least one seal is employed to seal between the exterior of the body at a first position along the body and the inner surface of the casing to prevent oil or gas flow past the exterior of the body. In the preferred embodiment, two seals are utilized. The body has an upper vent to vent the upper chamber to the exterior of the body above the seals. The body also has a lower vent to vent the lower chamber to the exterior of the body below the seals. A separator is provided for separating oil from a gaseous oil mixture and permitting the separated oil to flow into the upper chamber. Structure is provided for stopping the flow of the separated oil into the upper chamber, permitting the gas pressure to build up in the casing below the tool and lift the tool, and the oil in the upper chamber and casing above the seal to the surface for recovery.

In accordance with another aspect of the present invention, the plastic is ABS plastic. Further, structure can be provided for free communication between the upper and lower chambers prior to the tool being submerged below the oil level to provide for rapid movement of the tool from the surface to the oil level. Further, structure can be provided to control the fall of the tool from the surface to the oil level.

BRIEF DESCRIPTION OF THE DRAWINGS

With reference now to the following Detailed Description taken in conjunction with the accompanying drawings, wherein.

DETAILED DESCRIPTION

Figure 1:
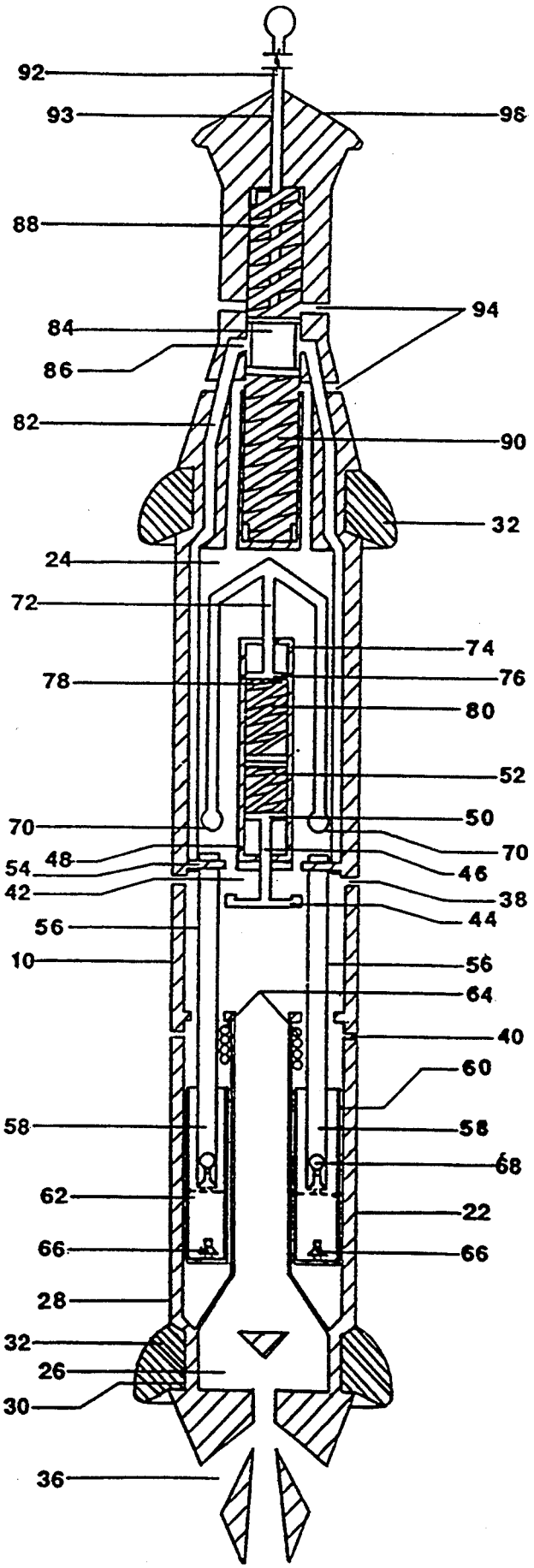
FIG. 1 is a vertical cross sectional view of a pump tool forming a first embodiment of the present invention.
Figure 1A:
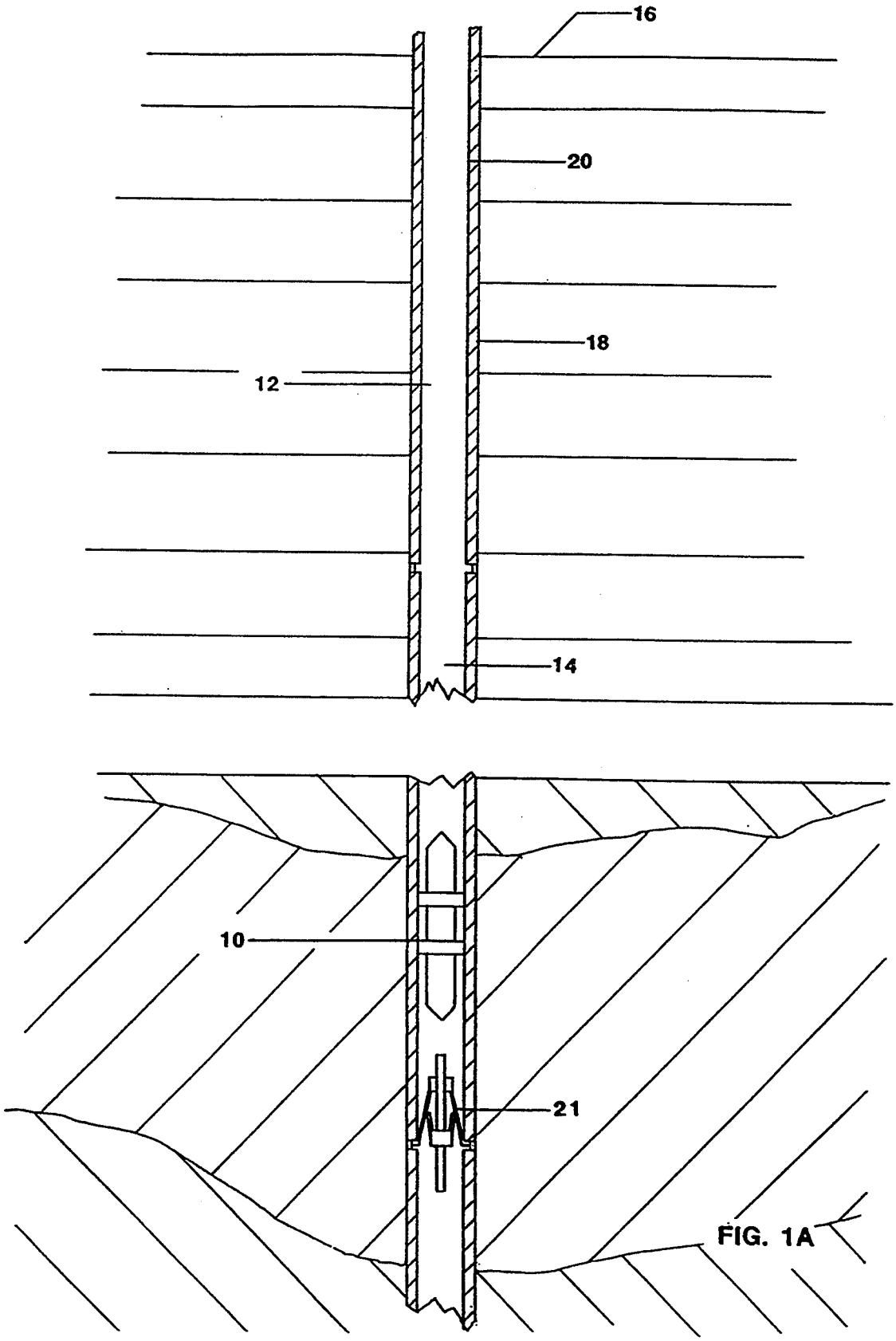
FIG. 1A is an illustrative view of a well in which the pump tool can be used.

With reference now to the drawings, wherein like reference numerals designate like or corresponding parts throughout the several views, and in particular to FIGS. 1 and 1A, a pump tool 10 is illustrated which forms a first embodiment of the present invention.

The pump tool 10 is employed within a well 12 having a significant gas pressure to pump oil from its natural level 14 to the surface 16 by the use of the gas pressure within the well alone. The pump tool 10 operates within a casing 18 of relatively uniform interior diameter 20 which extends from the surface to well below the oil level 14. A stand 21 is secured in the casing 18 above the perforations into the producing formation.

The pump tool 10 includes a body 22 which is preferably formed of ABS plastic. The body 22 has a hollow interior which is broadly separated into an upper chamber 24 and a lower chamber 26.

At one position along the length of the exterior 28 of the body is formed an annular seat 30 for a cup seal 32. The cup seal 32 seals between the exterior of the pump tool and the inner wall of the casing 18 to prevent oil or gas from flowing around the exterior of the pump tool past the seal. Thus, the only path for gas and oil flow in the casing between the section above the seal and the section below the seal is through the interior of the tool 10 itself.

A labyrinth passage 36 in the body connects the bottom of the lower chamber 26 with the interior of the casing below the seal. The purpose of the labyrinth passage 36, as will be described in greater detail hereinafter, is to provide sufficient aerodynamic resistance to the tool as it drops freely from the surface to the oil level 14 to prevent the tool from exceeding a velocity that would be likely to cause excessive wear to the seal 32 or damage to the tool as it drops into the oil downhole. A series of gas vents 38 and 40 are formed through the body near the top of the lower chamber 26 at two positions along the length of the tool.

The body 22 provides an annular opening 42 which connects the upper and lower chambers. However, a valve 44 is operable to seal against the body to close off the opening 42 and isolate the upper and lower chambers. The valve 44 is connected to a stem 46 extending into a sealed cylinder 48 formed in the body. The end of stem 46 is attached to a piston 50 which moves in sealed sliding contact with the interior surface of the sealed cylinder 48. A spring 52 acts between the interior end of the cylinder 48 and the upper surface of piston 50 to urge the piston 50 to the open position, allowing free flow between the upper and lower chambers. A gas is sealed within the cylinder in the chamber defined by the upper surface of the piston and the enclosing interior walls of the cylinder. The force of the spring 52 and the gas are sufficient to hold the valve open as the tool is dropped from the surface into the oil to facilitate rapid movement of the tool. However, once the tool drops below the oil level, the hydrostatic pressure of the oil will act on the lower face of the valve 44, causing the valve 44 to close and isolate the upper and lower chambers.

Forming the outer perimeter of the annular opening 42 is an annular plate 54. A pair of tubes 56 extend from the plate 54 downward into the lower chamber 26. The tubes have a passage 58 therethrough which provide for communication between the upper chamber and lower chamber. Guided on tubes 56 is an annular float 60. The float defines an annular chamber 62 which communicates with the lower chamber through ports 64 near the upper end of the chamber 62. The lower ends of tubes 56 extend through the float and into the chamber 62 as illustrated. A tube seal 66 is mounted at the bottom of chamber 62 beneath each of the tubes 56 to seal the passages 58 from the chamber 62 if the chamber 62 floats upward to the position denoted in the dotted line in FIG. 1. Within each tube 56 is also provided a fall valve 68 which permits only one-way flow from the chamber 62 into the passages.

The tubes 56, float 60 and seal ball 68 combine to form an oil separator for separating oil from a oil gas mixture in the lower chamber. The fundamental principles of the separator are disclosed in U.S. Pat. No. 3,410,217, issued Nov. 12, 1968 to Kelly, et al, which patent is hereby incorporated by reference in its entirety.

In operation, the float will move upward into the dotted line position, isolating the chamber 62 from passages 58, when there is an oil/gas mixture in the chamber 62. However, as oil rises in the casing to the level of the ports 64, the oil will fill the chamber 62, making the float heavier relative to the oil and gas mixture in the lower chamber and permitting the float to descend within the chamber to the position shown in FIG. 1. This opens the float connection between chamber 62 and the passages 58 to allow the pump tool 10 to descend further into the casing with the oil in chamber 62 moving through the passages into the upper chamber to fill the upper chamber, and out ports 34 to the interior of the casing above the cup seal 32.

The pump tool 10 continues to drop within the casing, with a hydrostatic head of oil above the tool until valves 70 move downward in the tool in response to the increased hydrostatic head to seal off the tubes 56 from the upper chamber 24. The valves 70 are mounted on a rod 72 which extends into a second sealed cylinder 74. The end of rod 72 extending into the cylinder is connected to a piston 76 which moves in slidable sealed motion with the interior surface of the cylinder 74. The chamber 78 formed below the lower surface of piston 76 and the interior of the cylinder contains a gas at predetermined pressure and a spring 80 which both act to elevate the seals above the tubes to connect the upper chamber and passages 58. However, as the hydrostatic head of the oil above the tool increases, the seals and rod 72 are moved downward relative to the seal chamber against the force of the gas in chamber 78 and spring 80 until the seals seal against the upper ends of the tubes to isolate the passages from the upper chamber. When this happens, gas pressure begins to build up in the lower chamber and in the casing below the cup seal 32. The pressure build-up will eventually be sufficient to lift the tool 10, and the oil above it, to the surface where the oil can be recovered. Once the tool has reached the surface, and the oil has been recovered, a mechanism must be provided to release the gas pressure beneath the tool to allow the tool to fall again down the casing to begin the lifting cycle anew.

Figure 2:
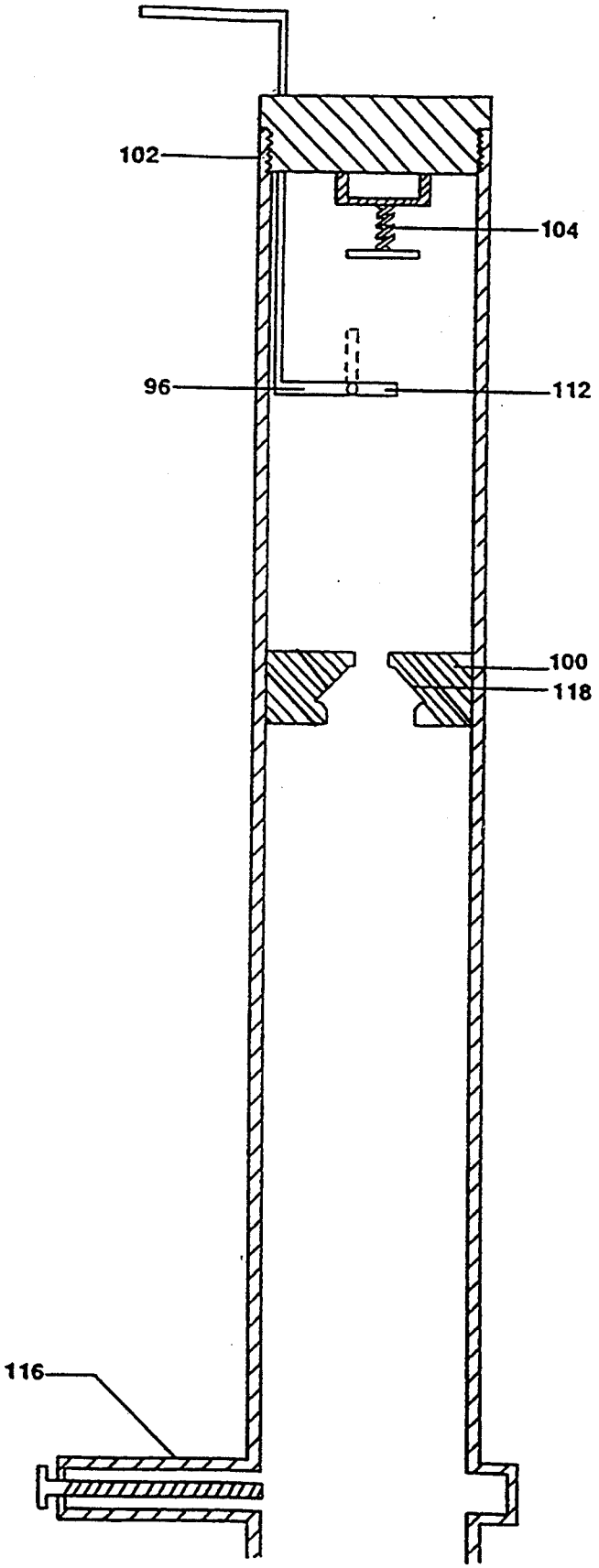
FIG. 2 is a vertical cross sectional view of a latch mechanism for the tool.

With reference to both FIGS. 1 and 2 the body 10 can be seen to define a passage 82 which receives a release piston 84. In the absence of external forces, the piston 84 is centered over ports 86 which connect the lower chamber with the upper chamber by springs 88 and 90. A rod 92 is connected to the piston and extends upwardly through a hole 93 in the body and for a predetermined distance above the tool. Ports 94 are formed through the body and open into the portion of the passage containing springs 88 and 90 to equalize the pressure on either side of the release piston 84.

The release piston 84, which acts as a pressure differential release system, is very important to allow release of a stuck tool. An important aspect of this system is that the pressure can be released by pulling up on the tool, as opposed to the conventional manner of striking a valve with a suspended weight. For example, in Gramling's tool disclosed in U.S. Pat. No. 4,070,134, at least a 100 lb weight is required to strike the release valve. In the present invention, a conventional wire line fishing tool can easily release the back pressure and retrieve the tool all in one trip down the hole, without the problem of launching the tool when it becomes unstuck with a high pressure beneath it so that it becomes a projectile launched from the casing.

As seen in FIG. 2, the upper portion of the casing is provided with a release piston activator 104 which is positioned in the path of the rod as the tool nears the surface to release the gas pressure and permit the tool to fall again into the casing.

Figure 3:
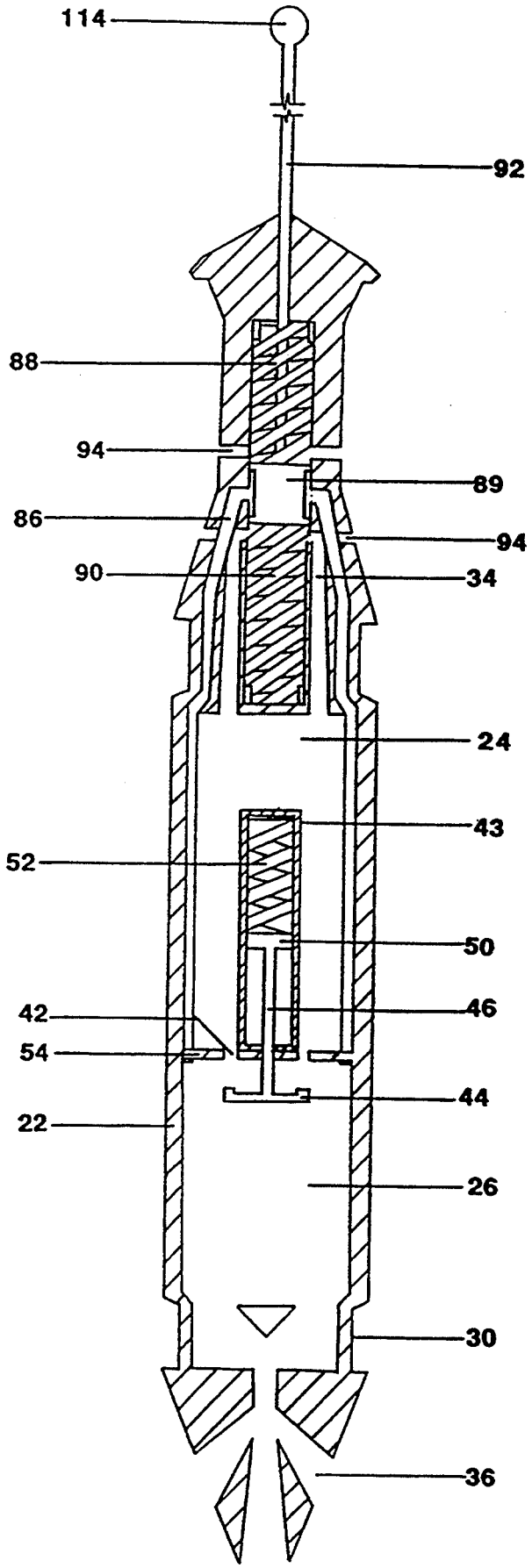
FIG. 3 is a vertical cross sectional view of a modification of the pump tool.

With reference to FIG. 3, a pump tool 110 forming a first modification of tool 10 is illustrated. The tool 110 is identical in many aspects with tool 10, and those elements of tool 110 identical to elements in tool 10 are identified with the same reference numerals. However, as will be observed, the tool 110 is a simpler design which does not incorporate an oil separator as provided in pump tool 10.

Figure 4:
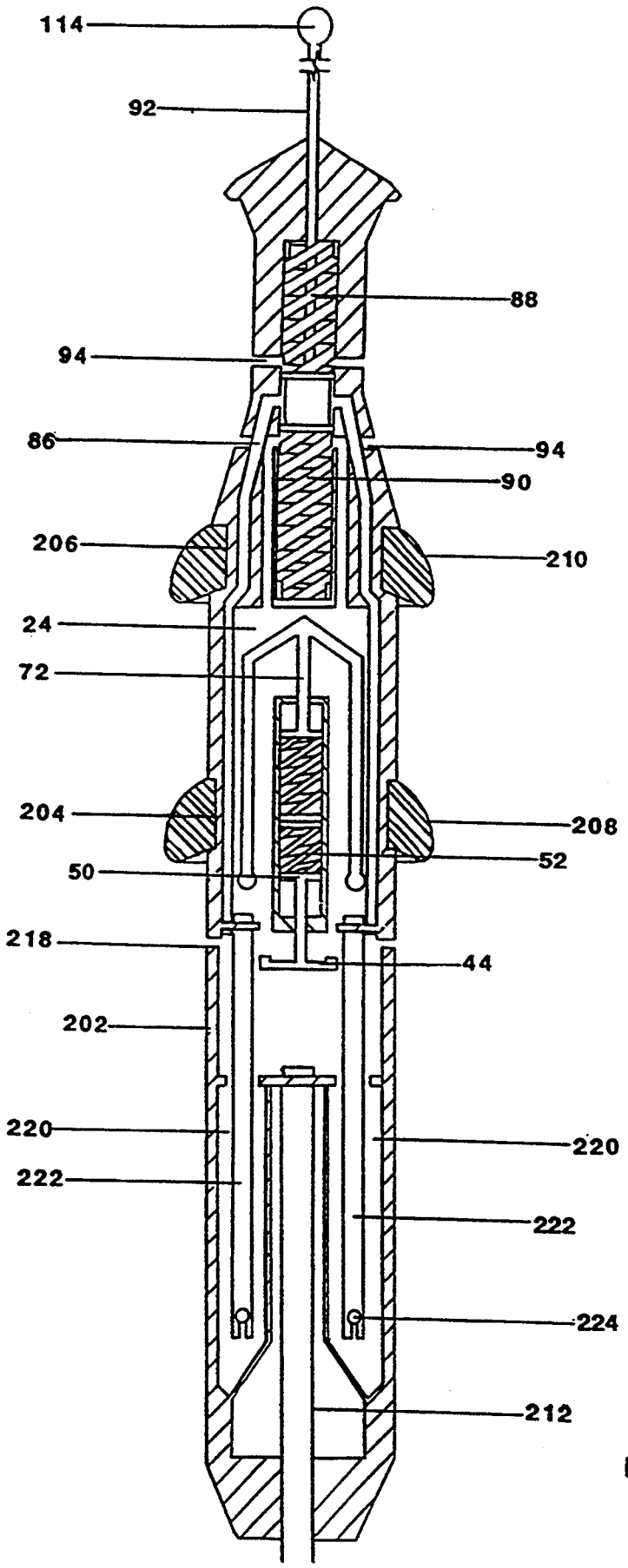
FIG. 4 is a vertical cross sectional view of a pump tool forming a second embodiment of the present invention.
Figure 5:
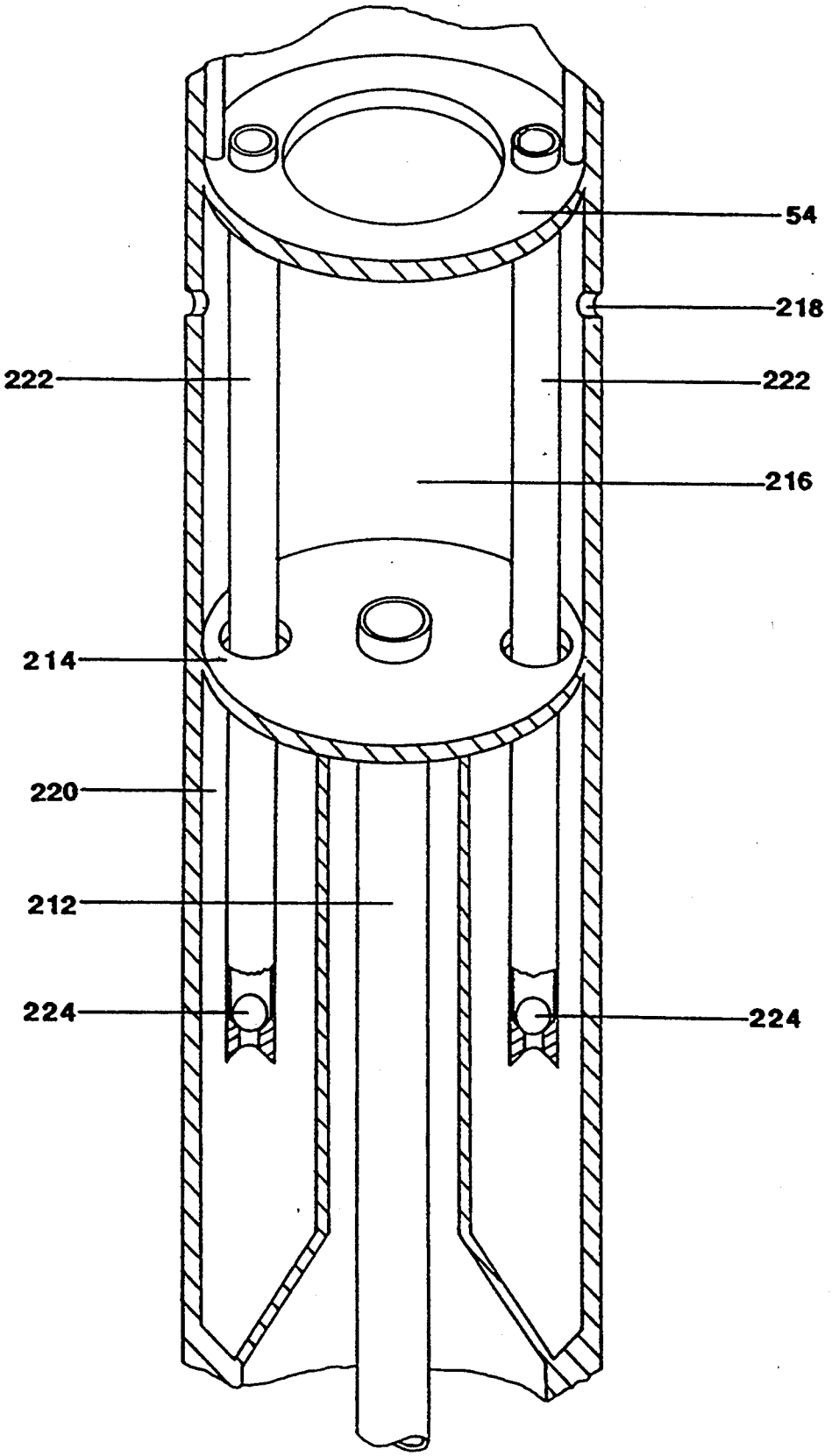
FIG. 5 is a detail view of a portion of the pump tool of FIG. 4.

With reference now to FIGS. 4 and 5, a second modification of the present invention is illustrated as pump tool 200. Many elements of pump tool 200 are identical in design and function to those in pump tool 10 and pump tool 110, and are therefore identified by the same reference numerals.

However, the body 202 of pump tool 200 can be seen to provide two annular seats 204 and 206 to receive cup seals 208 and 210 to seal between the body and the interior surface of casing 18. Body 202 also mounts an oil intake tube or tail 212 which extends downwardly into the oil within the casing. The tail 212 consists of a flexible tube, preferably assembled of 10 foot long sections which are attachable in series to any total tail length desired. Each section or length is weighted to keep the tail vertical and to allow it to sink into the oil.

In operation, the pump tool will cause gas to stay below the tool body 202, in effect causing a gas bubble to grow in the casing as more oil is processed. As compared to pump tool 10 and 110, the gas bubble generated cannot shut down the separator when the bubble grows down past the oil intake for the separator, thereby depriving the unit of the oil supply. The tail 212 allows the separator to continue functioning since it will ensure an oil supply to the separator at all times. Oil will be forced up the interior passage through the tail by the pressure differential between the area above the tool 200 and the sealed off area below the tool. A tail length of 40' to 60' could be used, for example, to ensure adequate separation.

As seen in FIG. 5, the upper end of the tail 212 opens into the separator 214 which includes a cavity 216 which is vented at its upper portion to the casing through gas venting ports 218. The oil can flow into annular cavities 220 to the bottom of the cavities and then up the interior of tubes 222. The lower end of each tube 222 mounts a one-way ball valve 224, while the upper end of each tube opens through the annular plate 54.

Referring again to FIG. 2, a movable arm 96 is provided at the surface which can be used to catch the tool 10, 110 or 200 for servicing. The arm can be moved from a stored position against the wall of the casing 18 to a central position, as seen in FIG. 2. The tool is then caught on its next upward trip by the arm. A spring loaded horseshoe 112 is mounted on the end of the movable arm which will lay horizontally, as seen in FIG. 2, until the head of the pump tool pushes it vertically as it passes by. When the head clears the horseshoe 112, spring loading will snap the horseshoe 112 back to a horizontal position, in which it will be surrounding the long neck portion of head 114 of the tool 10, 110 or 200. When the tool completes its upward trip, and starts to fall back down, the portion 114 will become wedged into the horseshoe, thereby leaving the tool hanging. The master valve 116 can then be closed and the tool safely removed for servicing.

The rubber bumper 100 acts as a safety device designed to catch the tool if it comes up the casing too fast. Under normal operating conditions, the body will not even touch the bumper, since the springs in the top of the tool should adequately cushion a normal trip termination. However, should the tool come up too hard, the springs in the body would not be sufficient to prevent damage. The rubber bumper 100 is put in such a position as to catch the head of the tool before damage can occur to the tool. The concave area 118 of the bumper is cut to fit the head of the tool. If the tool hits it very hard, it will become wedged in and thus suspended in the bumper 100. The master valve 116 can then be closed and the tool removed for servicing.

The use of a master valve 116 allows the well to be closed off before removing the tool, eliminating the risk of a blowout. A one-way pressure valve on top of the unit will allow for safe operation of a wire-line unit used for cleaning casings as well as placing the stand, or fishing for a stuck pump tool. Older systems required these operations to be done with the well open to the atmosphere, and blowouts and fire hazards were a very dangerous by-product due to methane escaping from the open well.

The use of plastic in the tool has significant advantages. Plastic saves weight, which translates into more oil production per trip. Blowouts caused by sparks are a major danger for prior metal based tools. The use of plastic eliminates the risk of such sparks in removing or inserting the tool. Plastic can also function in salt water and hydrogen sulfide ($H_2S$) which corrode normal metal tools. Salt water is extremely common in wells, while hydrogen sulfide is less common, but does occur.

The springs used in the tool will be of spring metal, but will be coated in a synthetic covering to prevent corrosion. The head 114 and plunger rod 92 will be formed of brass or bronze, both of which are resistant to salt water and hydrogen sulfide corrosion. Further, neither brass nor bronze will spark against other metals, again lessening the chance of a fire. The stand 21 will utilize a mixture of plastic and coated metals, all of which will be corrosion resistant.

Figure 6:
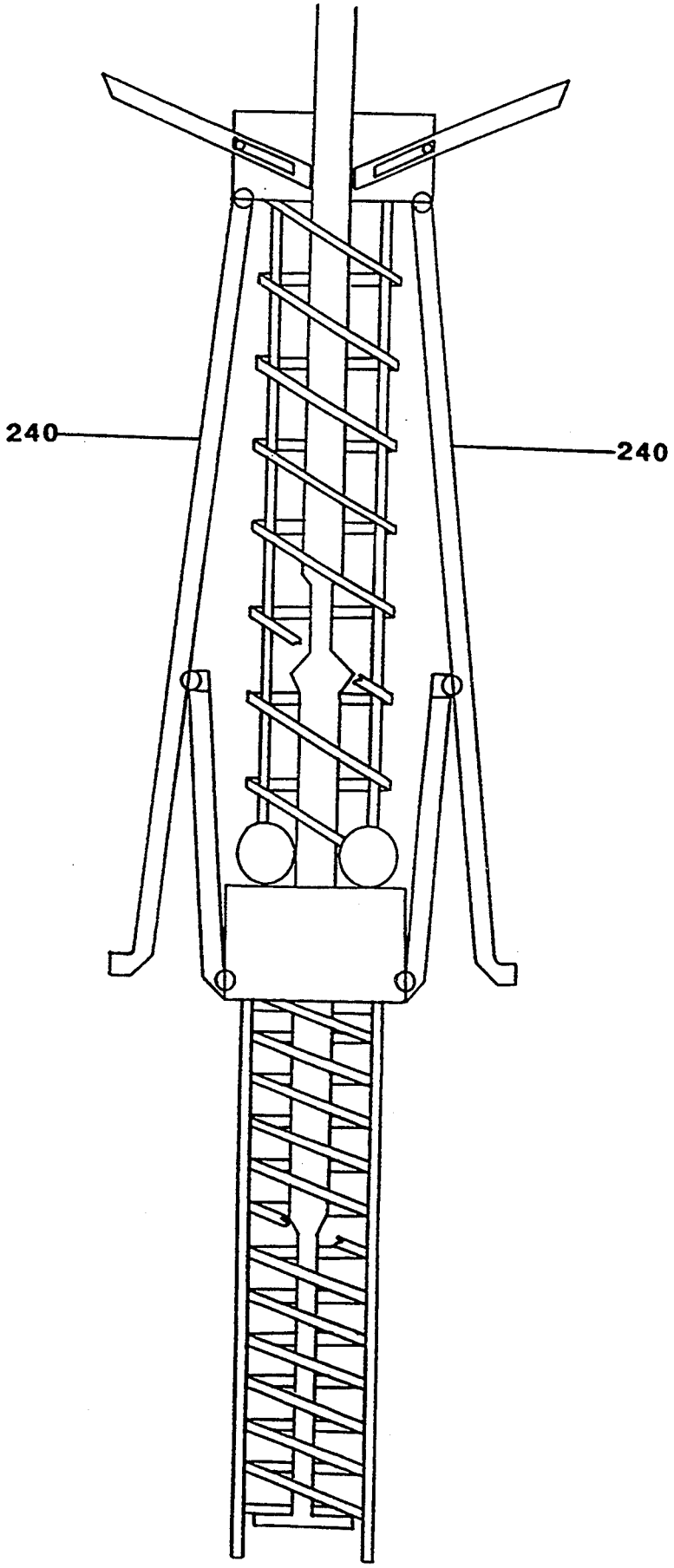
FIG. 6 is a side view of a stand utilized with the pump tool.

The stand 21 is used to prevent the tool from falling all of the way to the bottom of the well should a valve malfunction. The stand 21 should be set at the nearest casing Joint above the perforations into the producing formation. As best seen in FIG. 6, the stand 21 can be seen to have spring loaded arms 240 which engage the sides of casing 18, preferably at a casing joint to provide a stable attachment of the stand to the casing.

The manufacture of the body 22 in either pump tool 10 or pump tool 110 provides a significant advantage. For example, the overall weight of the tool can be reduced to a weight between about 10 and 20 lbs. as opposed to a weight of about 80 lbs. for casing pumps having bodies of metal. The weight saving translates directly to increased production of oil.

Figure 7:
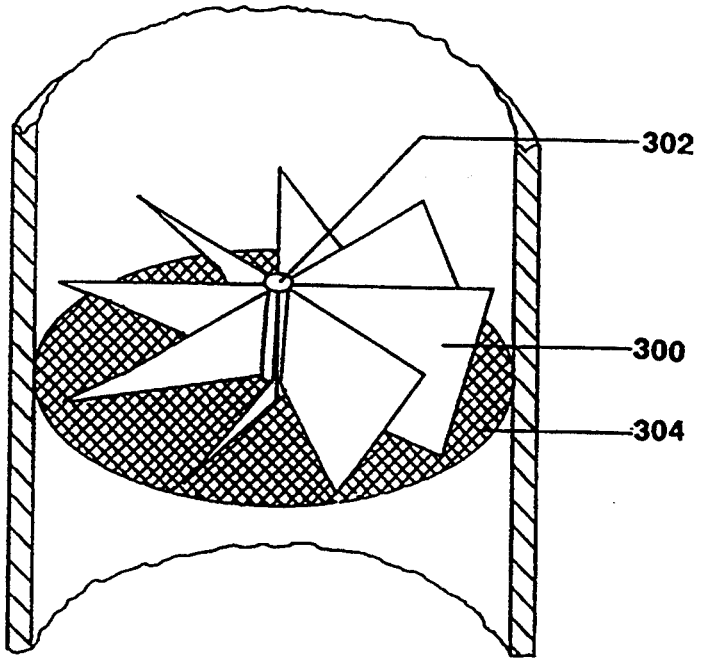
FIG. 7 is a perspective view of a horizontal wind turbine which can be used on the pump tools to slow descent.

With reference now to FIG. 7, a horizontal wind turbine 300 can be seen which is mounted for rotation on a shaft 302. Shaft 302, in turn, is secured to pump tool 10, 110 or 200 so that the wind turbine is placed in the air flow through the tools as the tools descend within the casing. An air inlet screen 304 can be used to prevent debris from injuring the blades of the turbine 300. The turbine has blades which are set to spin as the air flows past the blades as the tools descend in the casing. This provides resistance to the downward motion of the pump tool to slow the descent speed of the tools. In addition, the turbine can be mounted on the shaft so that the shaft rotates as well, which gives rise to the possibility of powering an electrical device on the tool by connecting the shaft to a generator.

Figure 8:
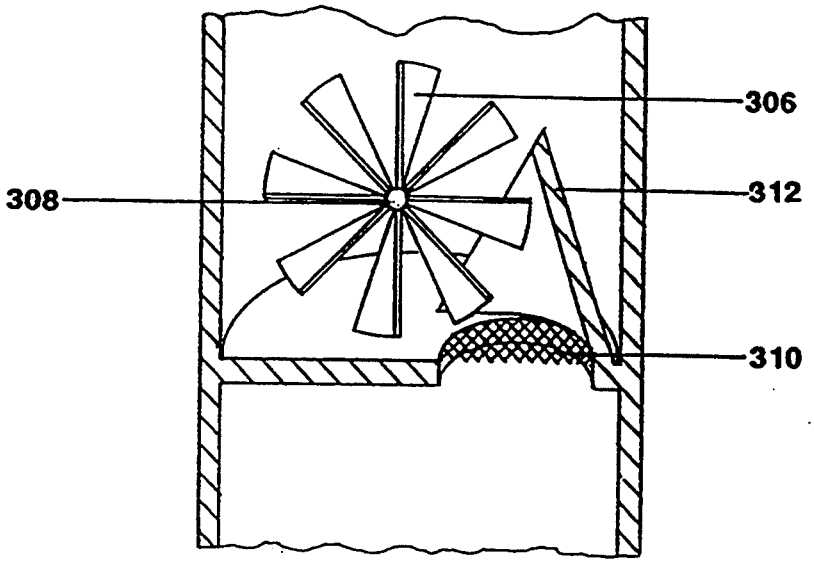
FIG. 8 is a perspective view of a vertical wind turbine which can be used to slow descent.

FIG. 8 shows a modification of the wind turbine concept with a vertically mounted wind turbine 306. The turbine would be mounted on a horizontally extending shaft 308. An air inlet screen 310 and an air guide 312 can be used to direct the air flow directly to the blades of the vertical wind turbine as illustrated.

Figure 9:
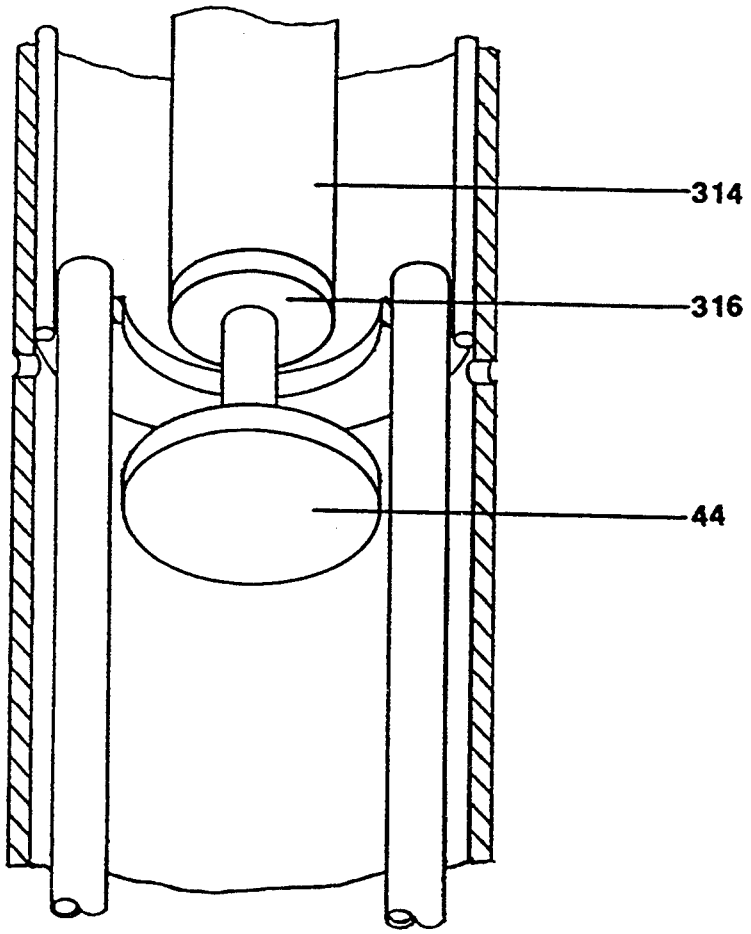
FIG. 9 is a magnetic valve seating apparatus which can be used on the tools.
Figure 10:
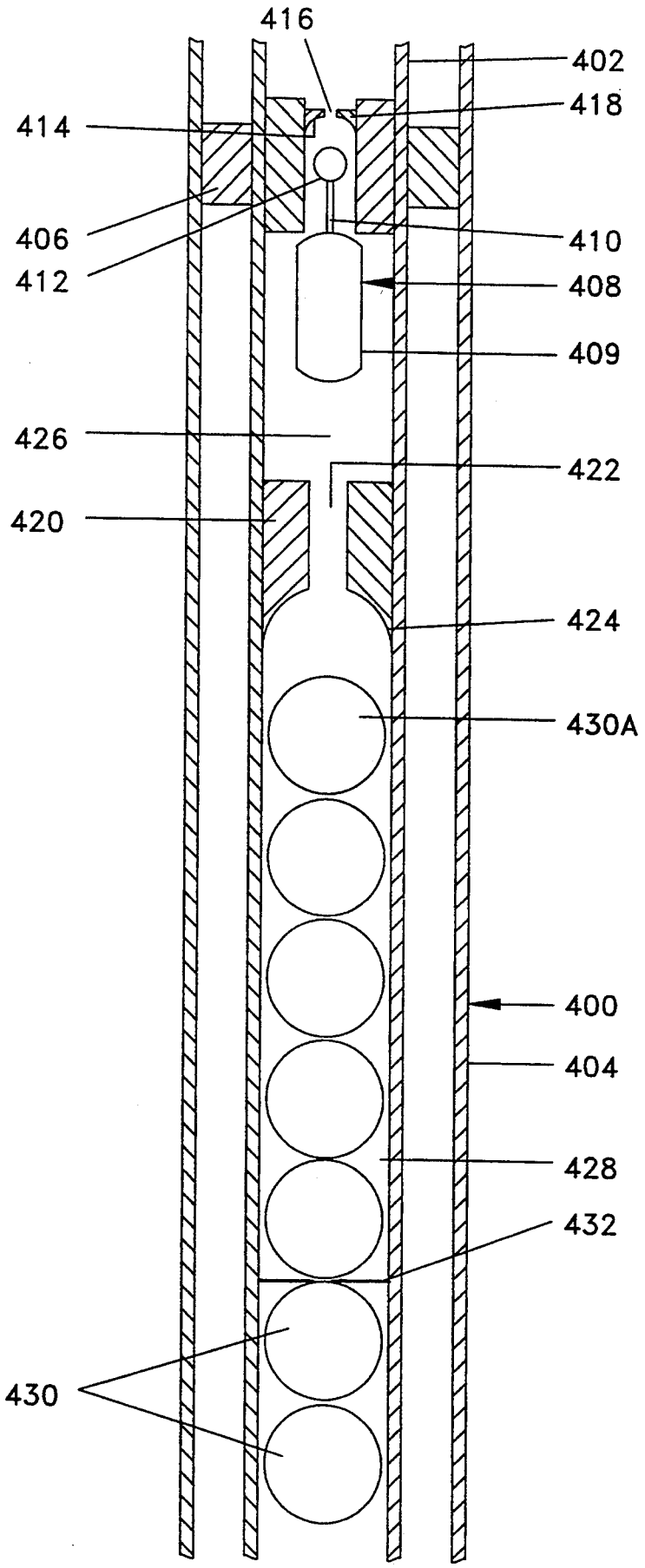
FIG. 10 is a vertical cross sectional view of another embodiment of the present invention.

FIG. 9 illustrates a magnetic valve seating apparatus 314 which can be used on pump tools 10, 110 and 200. The apparatus 314 includes an annular magnet 316 mounted on the tools as shown so that as valve 44 nears the closed position, the pressure that builds up around the valve face that could prevent full closure of the valve and a resulting stagnation of the rabbit, is overcome by the magnetic attraction of the valve 44 to the magnet 316 to assure complete closure.

With reference now to FIGS. 10–15, a tool 400 forming a second embodiment of the present invention will be described.

The purpose of tool 400 is to alleviate the need to produce salt water from gas wells completely, or, in the alternative, to substantially reduce the amount of salt water produced from gas wells. This will make many wells profitable that today that are unprofitable to operate, and enhance the profits on wells which produce a profit already. This invention will additionally provide a cheap, safe and ecologically sound alternative to present disposal methods in use. Utilization of this invention will substantially conserve the drive mechanism of water drive gas reservoirs by leaving the water in place in the formation. This invention will also have a beneficial ecological impact, because many operators currently use unapproved disposal wells to dump salt water, thereby polluting fresh water aquifers. Some operators also dump the water on the ground, sterilizing the soil for decades. This invention will remove the economic incentive to break the law.

While the tool will function inside any annulus, in FIGS. 10–15 the tool is depicted as part of a standard section of production tubing 402 set inside a string of standard casing 404. A packer 406 is set between the casing and production tubing to form a seal therebetween. A pressure sensitive valve 408 forms part of tool 400 and has a valve body 409, a plunger 410 and a stainless steel ball 412. The valve body 409 is secured to the tool 400 and has a chamber isolated from the surrounding environment so that a pressure change will cause the plunger 410 to move one way or the other depending on a pressure change. When low pressure is encountered within the tool 400, the plunger 410 will be fully extended to engage ball 412 with the valve seat 414 about orifice 416. When the ball engages the seal surface 414, movement of fluid or gas is prevented through the orifice 416. Preferably, the orifice 416 is surrounded by a magnetic ring 418 which has an attracting effect to the ball 412 when it is proximate the seal surface 414.

Below the valve 408 is a block 420 with a channel 422 formed therethrough. The block 420 defines a downwardly facing seal surface 424. The block 420 divides the tool into an upper chamber 426 and a lower chamber 428 within the tool. Below the block 420 are a number of free floating balls 430 which have a density less than that of the water in the well, and preferably about one-half the density of the water in the well.

If the ball 412 is sealed against the seal surface 414, the orifice 416 is completely sealed off. In this state, the production tubing 402 is totally sealed off below orifice 416. As gas bubbles out of the formation below the tool and rises in the water, it seeks the highest point obtainable. With the water level 432 relatively high in the tool, the uppermost ball **430*a* is held against the seal surface 424 by the buoyancy of the other balls 430 acting on ball 430*a*. With the channel 422 closed, gas will accumulate at the underside of the block 420 and within the tool to form a gas head of a particular height. As more and more gas collects, it will form a gas head that starts to force the water level 432 downward within the tubing 402. When the water level 432 has been forced down the tubing to a point equal to approximately the center of the column of balls 430, the uppermost ball 430***a* will move away from the seal surface 424 because the buoyancy force acting on the balls will no longer be sufficient to hold the ball 430*a* against the seal surface 424. As ball 430*a* moves away from the channel 422, the channel 422 will open and gas will flow through the channel to the upper chamber 426 to equalize the pressure in the upper and lower chambers. The valve 408 will maintain the orifice 416 closed because the accumulated gas pressure is not yet sufficient to precipitate a change in the position of the plunger 410 by acting upon the valve 408.

As the gas head continues to grow in size and pressure, it forces the water level even further downward. Eventually, the gas pressure will build to a point where it begins to act on the valve 408, causing the ball 412 to begin to open. However, the stainless steel ball 412 is held against the orifice 416 by the magnetic ring 418. When the gas head pressure reaches a point at which the retractive force of valve 408 overcomes the attractive force of the magnetic ring 418 on stainless steel ball 12, the valve will move out of engagement with the seal surface 414 and the orifice 416 will be open suddenly as the ball 412 breaks free of the magnetic ring.

When valve 408 opens, the pressurized gas will rush through orifice 416 into the tubing above the orifice 416. The movement of this gas has the effect of reducing the gas pressure below the orifice 416 and below the channel 422 so that the water level 432 begins to rise within the tool. Eventually, the water level will be sufficiently high to engage ball 430*a* with the seal surface 424 to seal off the channel 422 and stop the rise of the water level 432. As the pressure in the upper chamber 426 decreases by flow through the orifice 416, the valve 408 will react to urge the ball 412 into sealing engagement with the seal surfaces 414 about the orifice 416 to seal off the orifice. The cycle is then ready to repeat and will continue to repeat until the gas supply is no longer available.

As can be understood, the present invention has the significant advantage of pressurizing the well below the tool 400 to control the water level and eliminate the discharge of water along with a gas which would require the costly disposal techniques discussed previously.

It is also possible to use the tool 400 without the valve 408 and orifice 416. The tool 400 will operate in substantially the same manner, with the balls 430 alternatively rising with the water level to close the channel 422 and falling as the gas pressure builds up to open the channel 422 and let the gas pass through the channel. Balls are not required, any floating object placed in the tool that is capable of forming a seal at the top of the tool will perform the function adequately. For example, an elongate float with a seal end can be used. An important requirement is that the floating object be long enough in buoyancy effect to allow a generous amount of gas to accumulate at the top of the tool before the falling water level opens the tool to the annulus above.

Figure 12:
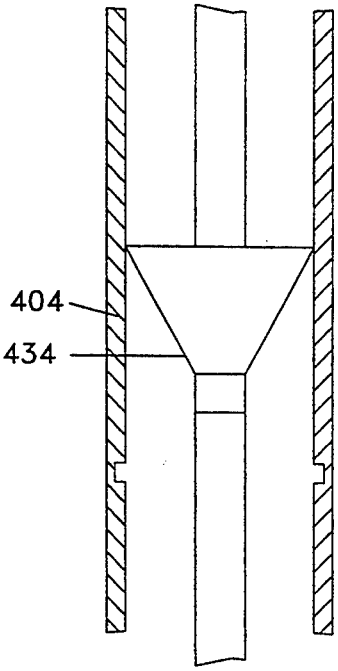
FIG. 12 is a view of the seal during installation.
Figure 11:
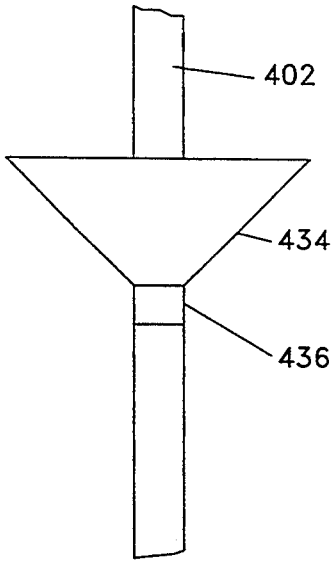
FIG. 11 illustrates the use of a particular seal with the device of FIG. 10.

While the tool 400 will work with any suitable packer 406, one design for a packer 434 is illustrated in FIGS. 11–15. The present invention is best suited for use with a flexible seal which can be moved up or down within the bore hole easily. The packer 434 is attached to the tubing 402 by a collar 436. The packer 434, prior to being inserted into the casing 404, has a shape of an upside down parasol, as depicted in FIG. 11. When the packer 434 is inserted into the casing 404, the packer is folded back and upwards by the walls of the casing 404 as shown in FIG. 12.

Figure 13:
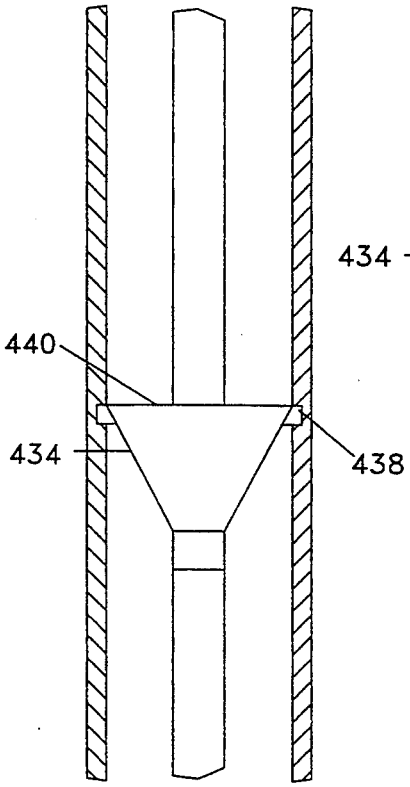
FIG. 13 is a view of the seal about to be deployed.
Figure 14:
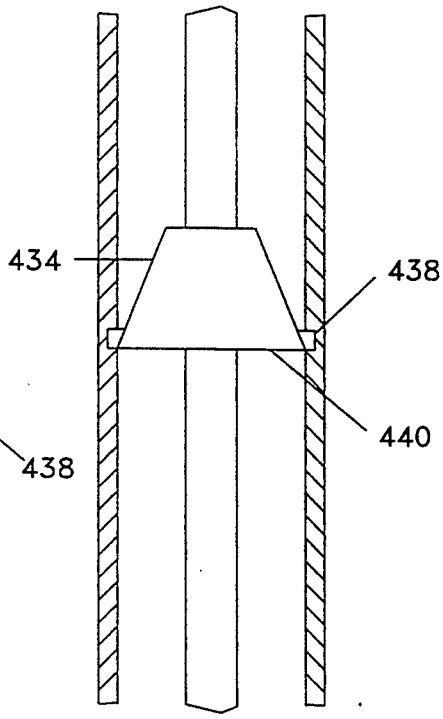
FIG. 14 is a view of the seal deployed.
Figure 15:
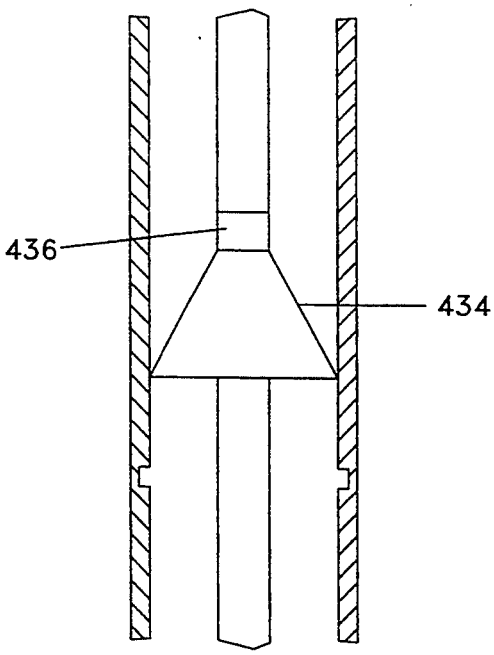
FIG. 15 is a view of the seal in the sealing position.

When the packer 434 is pushed down to the appropriate depth in the well, it must be pushed one casing joint 438 below its desired final position. This is so that the trailing edge 440 of the packer 434, which is in contact with the casing 404, will catch in the casing joint 438 as seen in FIG. 13. As the packer 434 is pulled upwardly, the edge 440 becomes locked in the casing joint 438 and remains stationary as the packer 434 and tubing 402 continue to move upwardly. The packer 434 will then start to turn inside out, as seen in FIG. 14. As the collar 436 and tubing 402 rises above the casing joint 438, the packer 434 is turned completely inside out as shown in FIG. 15. The packer 434 can then be raised to its final position, providing a complete seal between the casing 404 and the tubing 402. As the pressure below the packer 434 increases, it will force the packer to expand against the inner surface of the casing 404. Thus, the greater the pressure, the tighter the seal against the casing. By repeating these procedures, it is possible to reposition the packer in the well bore as needed from time to time by simply moving the tubing 402 up or down within the casing.

The invention 400 will function in any annulus where gas and liquid are present and a pressure differential zone can be created by use of the valve 400. A wide range of materials can be utilized in fabricating this invention, thus making it functional in many environments normally hostile to metals.

This invention may be used in conjunction with gas powered plungers, such as those disclosed herein and the systems depicted in U.S. Pat. No. 4,070,134 issued to Gramling and U.S. Pat. No. 4,696,624 issued to Bass. The use of the tool 400 in conjunction with the aforementioned plunger lift tools may be accomplished by placing the tool 400 below the lowest point of travel of the plunger lift tools, thereby supplying gas free of water to be used as a power source. The present invention may also be utilized in multiples in a single well.

In certain wells, it may be necessary to keep channel 422 and orifice 416 open to facilitate installation of the invention and allow complete swabbing of the well to initiate the production cycle. This can be accomplished with respect to channel 422 by placing a temporary uppermost ball 430 into the invention upon insertion into the well. This temporary ball 430 is constructed of a mesh-like material and is completely hollow. The temporary ball is also made of a water soluble material which dissolves at a known rate. The material can be altered to provide for more or less time to swab dry according to the characteristics of any particular well. When this temporary ball is in place, water will flow freely through it, thus keeping channel 422 open. Orifice 416 will remain open when there is any significant amount of water above it due to the pressure acting upon the valve 408.

Figure 16:
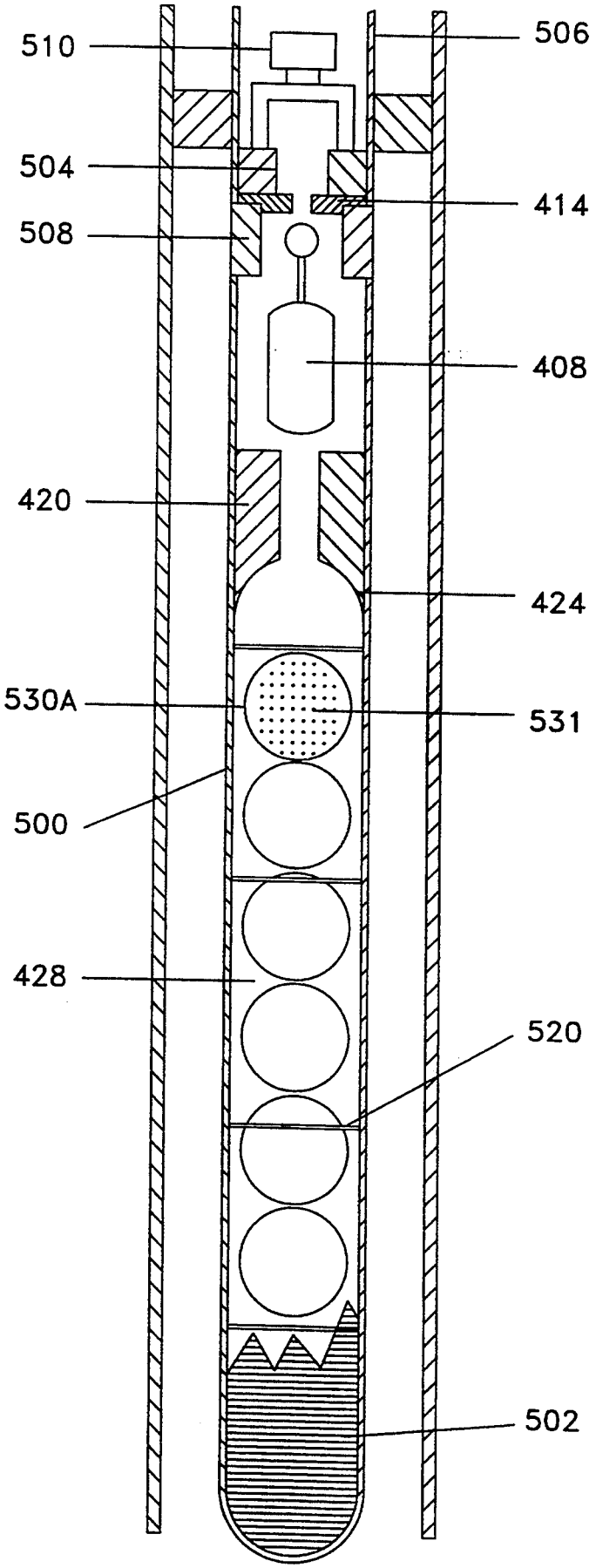
FIG. 16 is a vertical cross sectional view of another embodiment of the present invention.

With reference to FIG. 16, a third embodiment of the present invention, tool 500, will be described. Many elements of tool 500 are identical in form and function to those in tool 400, and those elements have been identified by the same reference numeral. In some circumstances, it may be possible that the uppermost ball, ball 430*a*, in tool 400 could be held in place against the seal surface 424 by the differential in pressure, and thus never drop. To prevent this from happening, the uppermost ball 530*a*, as illustrated in FIG. 16, has an external surface 531 which is irregular enough to produce an imperfect seal against the seal surface 424 when it travels to the highest point in the lower chamber 428 against the surface 424. This will allow the ball 530*a* to still create a significant drop in pressure on the valve 408, thus causing the valve 408 to close. However, the leaky seal between ball 530*a* and the seal surface 424 will eventually allow the pressure above and below the block 420 to equalize, thereby making it possible for the uppermost ball 530*a* to drop from the orifice when the water level has dropped far enough so that the ball is not held against the seal surface by buoyancy. The outer surface of the ball 530*a* can, for example, have a system of grooves or dimples on the sphere which produce a slow leak past the seal surface 424 even when the ball 530*a* is tightly urged against the seal surface 424 by the water pressure. The ball 530*a* could have the external appearance of a golf ball, for example. The surface irregularities on the ball 530*a* should be sufficient to produce a slow leak that will equalize pressure across the block 420 within a period of several minutes or less.

Tool 500 is also provided with a screen or mesh 502 which is attached at its upper end to the block 420 and extends downward through the lower chamber 428 to contain the ball 530*a* and the other balls 430 through their entire range of motion. The mesh 502 is intended to minimize the risk of any debris making its way up the lower chamber 428 to the seal surface 428 or thereabove to the valve seat 414, thus preventing a complete closure from occurring. The mesh 502 extends only up to the seat for the uppermost ball 530, but would encase all the balls below that point. A ball guide 520 can be used in conjunction with the mesh to facilitate the up an down motion of the balls.

The tool 500 is also designed to be insertable and retrievable by wire line. A collar 504 is placed at the lower end of the last piece of tubing 506. A mating collar 508 is mounted at the top of the tool 500 to be placed in the well. The tool 500 is then lowered into the well on a wire line through the tubing, and dropped through the collar 504 until the collar 504 and 508 meet and lock together. The tool 500 will have a standard fishing head 510 on the top of the tool for the wire line to engage in a manner well known in the industry. When the tool 500 must be removed for servicing, a wire line can be dropped through the tubing to engage the head 510 and the tool lifted in a manner to unlock collars 504 and 508 and allow the tool 500 to be drawn to the surface through the tubing for servicing and repair. This avoids the requirement to pull the entire tubing string each time the tool needs to be serviced.

With reference to FIGS. 17–20, a fourth embodiment of the present invention, tool 600, will be described. Tool 600 has an integral valve closure delay system as will be explained in detail hereinafter. Further, the tool has been formed into two units, upper unit 602 and lower unit 604. This allows for fine tuning of the system by moving the upper unit 602 to control valve timing. The upper unit may actually be placed at the surface in some wells.

Figure 17:
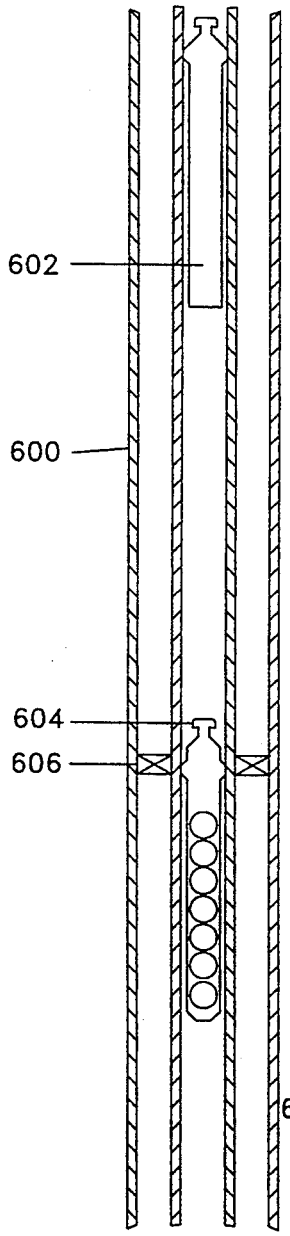
FIG. 17 is a cross sectional view of a well showing another embodiment of the invention.

The lower unit 604 is designed to be installed in the tubing of the gas well just above the perforations, with a packer 606 placed adjacent, as seen in FIG. 17. Upper unit 602 is placed in the tubing above lower unit 604 and at a predetermined height, even possibly at the surface. Both units are sealed against the inner wall of the tubing by O-ring seals 608.

As noted previously, the reservoir pressure determines the water level within the reservoir. Thus, the reservoir pressure must be artificially controlled to eliminate waste water production. This is the function of the lower unit 604, and specifically the floating balls or members 430 and 530*a*. As water encroaches up the tubing due to falling pressures, the water forces the floating balls or members 430 and 530*a* upward so that ball 530*a* moves into a sealed position against the seal surface 424. As noted previously, ball 530*a* is dimpled or etched to allow a slow pressure leakage. Even so, it will create an almost complete seal resulting in the buildup of pressure below the seal, which forces the water level to descend, replaced by the gas from the formation which will displace the water.

However, because the seal against seal surface 424 is imperfect, the slow leak therethrough will eventually cause the pressure to equalize between upper unit 602 and lower unit 604. Thus, the only force holding the ball 530*a* against the seal surface 424 is buoyancy. As the gas displaces the water beneath the ball 530*a*, the water will eventually lower in level to the point where the buoyancy forces no longer support the ball 530*a* against the seal surface 424, allowing the gas to pass up into the passage between lower unit 604 and upper unit 602.

Figure 18:
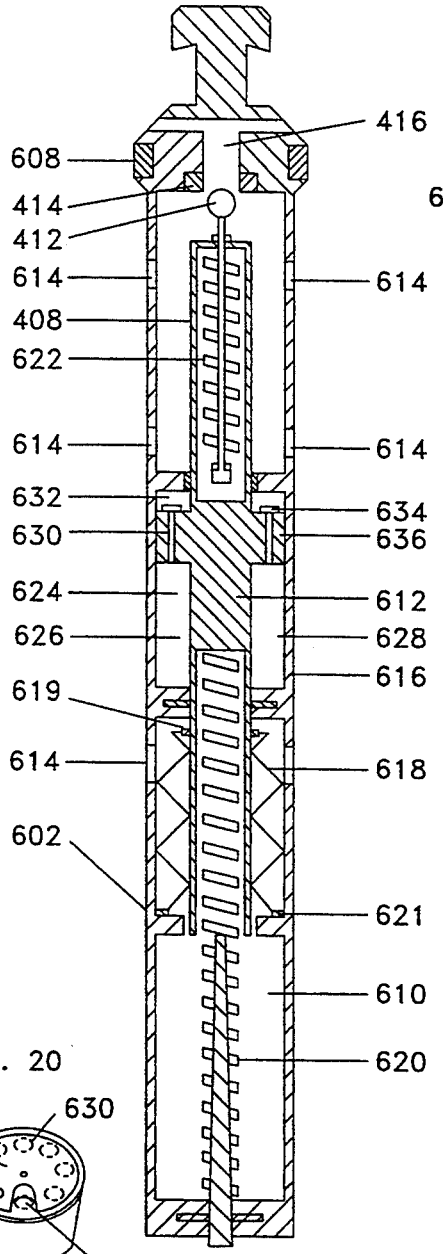
FIG. 18 is a cross-section of the upper part of the tool.
Figure 19:
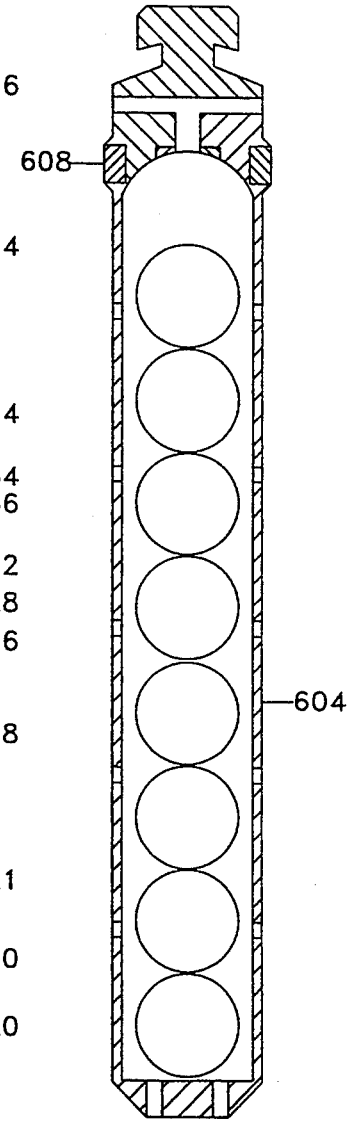
FIG. 19 is a cross section of the lower part of the tool.

The upper unit 602 has a body 616 and a motile valve carrier 612 which can move vertically within body 616 as seen in FIG. 18. An area 610 is defined between the body 616 and part of carrier 612 which is air filled and sealed at a predetermined pressure. As the gas pressure builds in the volume between the upper unit and the lower unit, and passes into the upper unit 602 through apertures 614, the valve carrier is forced downwardly relative to the body 616 of the upper unit 602 against the force of the pressure in area 610. Use of a bellows 618, sealed at one end 619 to the valve carrier and at the other end 621 to the body 616, allows the valve carrier to move while the pressure in area 610 remains constant. A spring 620 acts between the valve carrier 612 and the body 616 to assist the force of the pressure in area 610.

During this time, the ball 412 of valve 408 will be urged into sealing engagement with the seal surface 414 by the pressure differential above and below the valve seat. Because the valve 408 is mounted on the carrier as the carrier 612 moves downward, the spring 622 will be compressed.

Figure 20:
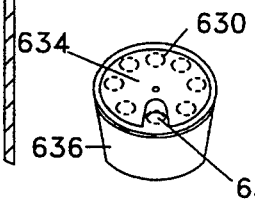
FIG. 20 is a view of the delay mechanism.

A chamber 624 is formed within the body 616 and is filled with a suitable liquid 626. The valve carrier defines a piston 636 which divides the chamber into upper portion 632 and lower portion 628. As the valve carrier 612 moves downwardly relative to the body, liquid is displaced from the lower portion 628 of the chamber through openings 630 in piston 636 and into the upper portion 632 of the chamber. A flap valve 634, best seen in FIG. 20, is mounted over all but one of the openings 630. However, as the carrier 612 moves downwardly, the flow of liquid through the opening 630 deflects the flap valve 634 away from the openings and there is little resistance to downward motion caused by the motion of liquid 626. When the valve carrier 612 has moved a given distance downward, the ball 412 will be pulled from the seal surface 414 and cleanly snapped away from the orifice by the action of the spring 622. Gas can then flow from beneath the upper unit 602, through orifice 616 for recovery.

As gas is produced, the reservoir pressure will begin to decline. As the pressure falls, the formation water will again rise and lift the floating members 430 and 530*a* in the lower unit 604. When the floating member 530*a* again engages the seal surface 424, the pressure above the lower unit 604 will decline rapidly. The force of the pressure within area 610 will then drive the carrier 612 upwardly to close valve 408. However, this upward motion will be delayed at a predetermined rate by the interaction of the flap valve 634 and the liquid 626 attempting to move from the upper portion 632 of chamber 624 to the lower portion 628 of the chamber. The upward movement of the valve carrier 612 causes the flap valve to tightly seal against all but one of the openings 630. Thus, the fluid must pass through the sole unobstructed opening, which slows the movement of the valve carrier upward. This delay will prevent valve chatter, since by the time the carrier 612 returns upward for the ball 412 to seal against seal surface 414, the pressure above and below the valve seat will be equalized. With the floating members 530*a* firmly sealed against seal surface 424, there will be no significant pressure differential below and above the upper unit 602, thereby allowing a clean closure of the valve in the upper unit.

While several embodiments of the present invention have been described in detail herein and shown in the accompanying drawings, it will be evident that further modifications, or substitutions of parts and elements are possible without departing from the scope and spirit of the invention.

We claim:

1. A tool for separating gas and water in a natural gas well, comprising:

a body defining an upper chamber, a lower chamber and a channel interconnecting the upper and lower chambers and having a fishing head at its upper end;

a member in the lower chamber of the body having a density less than the water in the gas well;

a downwardly facing seal surface formed on the body about the channel, the member floating upwardly directly against the seal surface to seal the channel from the lower chamber when the level of water exceeds a predetermined height and floating downwardly away from the seal surface to release the seal, permitting gas to flow from the lower chamber to the upper chamber through the channel when the level of water decreases below the predetermined height.

2. A tool for separating gas and water in a natural gas well, comprising:

a body defining an upper chamber, a lower chamber and a channel interconnecting the upper and lower chambers;

a member in the lower chamber of the body having a density less than the water in the gas well;

a seal surface formed on the body about the channel, the member floating against the seal surface to seal the channel from the lower chamber when the level of water exceeds a predetermined height and floating away from the seal surface to release the seal, permitting gas to flow from the lower chamber to the upper chamber through the channel when the level of water decreases below the predetermined height, said member being a plurality of balls having a density less than that of the water within the well, the balls stacked vertically so that the uppermost ball moves into contact with the seal surface on the body.

3. A tool for separating gas and water in a natural gas well, comprising:

a body defining an upper chamber, a lower chamber and a channel interconnecting the upper and lower chambers;

a member in the lower chamber of the body having a density less than the water in the gas well;

a seal surface formed on the body about the channel, the member floating against the seal surface to seal the channel from the lower chamber when the level of water exceeds a predetermined height and floating away from the seal surface to release the seal, permitting gas to flow from the lower chamber to the upper chamber through the channel when the level of water decreases below the predetermined height;

a pressure sensitive valve having a plunger and a ball mounted on the plunger, a member mounted in the tool having an orifice therethrough and defining a seal surface about the orifice, said valve being sensitive to pressure, pressure below a certain value causing the plunger to urge the ball into sealing engagement with the seal surface about the orifice, pressure at a second higher pressure level causing the ball to move out of sealing engagement with the seal surface about the orifice.

4. The tool of claim 3 wherein the member is magnetized about the orifice, the ball being formed of a material attracted by the magnetism into sealing engagement with the seal surface about the orifice.

5. A tool for separating gas and water in a natural gas well, comprising:

a body defining an upper chamber, a lower chamber and a channel interconnecting the upper and lower chambers;

a member in the lower chamber of the body having a density less than the water in the gas well;

a seal surface formed on the body about the channel, the member floating against the seal surface to seal the channel from the lower chamber when the level of water exceeds a predetermined height and floating away from the seal surface to release the seal, permitting gas to flow from the lower chamber to the upper chamber through the channel when the level of water decreases below the predetermined height, the member having an irregular exterior surface to form an imperfect seal against the seal surface when the level of water exceeds a predetermined height to assure the member will float away from the seal surface when the level of water decreases below the predetermined height.

6. An apparatus for separating gas and water in a natural gas well, comprising:

a first member separating the gas and water and passing gas through the first member at intervals;

a second member having a body and a valve carrier movable within the body, the second member defining an enclosed volume between the body and a portion of the valve carrier, a constant pressure being maintained within the volume, the body defining a seal surface and the carrier mounting a valve member for engaging the seal surface, passage of gas through the first member acting on a portion of the valve carrier to move the valve carrier and valve member away from the seal surface to move the valve member out of sealing engagement with the seal surface to allow gas to pass through the second member until the gas pressure is reduced, and means for delaying the return of the valve carrier and the valve member into engagement with the seal surface to prevent valve chatter.

7. The apparatus of claim 6 wherein said means for delaying the return includes a chamber formed between the body and said valve carrier, the valve carrier forming a piston with openings therethrough which divides the chamber into first and second portions, a fluid filling the chamber and a flap valve covering at least one of the openings to prevent fluid flow through the covered opening in one direction of movement of the valve carrier relative to the body.

8. A tool for separating gas and water in a natural gas well, comprising:

a body defining an upper chamber, a lower chamber and a channel interconnecting the upper and lower chambers;

a member in the lower chamber of the body having a density less than the water in the gas well;

a seal surface formed on the body about the channel, the member floating against the seal surface to seal the channel from the lower chamber when the level of water exceeds a predetermined height and floating away from the seal surface to release the seal, permitting gas to flow from the lower chamber to the upper chamber through the channel when the level of water decreases below the predetermined height;

a second body having a second member, the second member having a housing and a valve carrier movable within the housing, the second member defining a closed volume between the housing and a portion of the valve carrier, a constant pressure being maintained within the volume, the housing defining a second seal surface and a carrier mounting a valve member for engaging the second seal surface, the passage of gas through the channel acting on a portion of the valve carrier to move the valve carrier and valve member away from the second seal surface to move the valve member out of sealing engagement with the second seal surface to allow gas to pass through the second member until the gas pressure is reduced, and means for delaying the return of the valve carrier and the valve member into engagement with the second seal surface to prevent valve chatter.

9. The apparatus of claim 8 wherein said means for delaying the return includes a cavity formed between the housing and said valve carrier, the valve carrier forming a piston with openings therethrough which divides the cavity into first and second portions, a fluid filling the cavity and a flat valve covering at least one of the openings to prevent fluid flow through the covered opening in one direction of movement of the valve carrier relative the housing.

* * * * *